US005568743A

United States Patent [19]

Oppelt

[11] Patent Number: 5,568,743

[45] Date of Patent: Oct. 29, 1996

[54] AXIAL THREAD ROLLING HEAD

[75] Inventor: Klaus Oppelt, Lauenburg, Germany

[73] Assignee: Wilhelm Fette GmbH, Schwarzenbek, Germany

[21] Appl. No.: 300,412

[22] Filed: Sep. 2, 1994

[30] Foreign Application Priority Data

Sep. 3, 1993 [DE] Germany ..... 9313282 U

[51] Int. Cl.[6] ..... B21H 3/04; B21D 3/02

[52] U.S. Cl. ..... 72/121; 72/103; 72/104

[58] Field of Search ..... 72/103, 104, 118, 72/120, 121; 470/83; 82/54

[56] References Cited

U.S. PATENT DOCUMENTS

| | | | |
|---|---|---|---|
| 2,909,087 | 10/1959 | Powell | 72/103 |
| 3,352,139 | 11/1967 | Cummings | 72/121 |
| 3,365,924 | 1/1968 | Cummings | 72/121 |
| 4,771,625 | 9/1988 | Watanabe et al. | 72/121 |

*Primary Examiner*—Lowell A. Larson
*Assistant Examiner*—Rodney Butler
*Attorney, Agent, or Firm*—Vidas, Arrett & Steinkraus

[57] ABSTRACT

Axial thread rolling head which comprises a bearing unit including the thread rollers and rotatably supporting said thread rollers by means of eccentric shafts, an axial shank being axially movable with respect to said bearing unit and, in a first axial relative position, cooperating with a claw clutch portion of said bearing unit by means of a claw clutch portion to connect both portions so as to be resistant to torsional strength, a first gear between said shank and said eccentric shafts, a helical spring between said shank and said bearing unit being so provided that in a second axial relative position, in which said claw clutch portions are out of mesh, said helical spring, on the occasion of a displacement of said bearing unit into a first direction of rotation with respect to said shank, is tensioned or, respectively, said tensioned helical spring displaces said bearing unit into the second direction of rotation relative to said shank, spring means which tension said shank and said bearing unit into the first relative position towards each other, and mechanical switching means which, when getting into touch with a workpiece, cause said shank and said bearing unit to move into the second relative position, a power operated drive being arranged on said shank and connected to said bearing unit (LE) via a second gear for displacing said bearing unit into the first direction of rotation by a preset angle of rotation, with said shank and said bearing unit (LE) being in the second axial relative position.

11 Claims, 5 Drawing Sheets

6a
3a
III
40
42
92
52
48
50
44
46
1a
4a
18a
2a
58
30a
62
54
60
III

70'
72
1a
IV
70
48
52
54
IV 48
44
50
52
64
66

AXIAL THREAD ROLLING HEAD

SUMMARY OF THE INVENTION

The invention relates to an axial thread rolling head.

For reasons of saving time and a higher strength of the thread, many standard threads are rolled by means of rolling systems or rolling heads. There is distinguished between an axial, radial and tangential rolling head. The present invention relates to an axial rolling head.

BACKGROUND OF THE INVENTION

Conventional axial rolling heads comprise three profile rollers arranged offset by 120° which are rotatably supported within a bearing unit. The bearing unit is supported by a shank which is clamped into a machine tool. The rolling head is kept in the direction of rotation, however, can move axially. The rolling head is forced on the rotating workpiece, with the feed being made by the axially freely movable rolling head while milling the thread.

Upon completion of the thread milling it is necessary to disengage the profile rollers with the workpiece. It is known to arrange the profile rollers on eccentric shafts, the rotation of which results in a change of the distance between the profile rollers. It is also known to secure to the eccentric shafts small gear wheels meshing with a central gear wheel which is arranged on the shank in a fixed position and cannot rotate. A helical spring with the one end is secured to the bearing unit and with the other end it is secured to the shank. The helical spring is biased, with the profile rollers being, in the operating position. As soon as the feed has reached a preset value the workpiece abuts against a rod axially provided within the shank of the rolling head. As a result, the bearing unit and the shank are axially moved apart and thus a claw clutch is divided between said parts. Now the spring can displace the bearing, unit by a given angle by twisting. In this way, the gear wheels are caused to also roll on the central gear wheel and twist the eccentric shafts for displacing the profile rollers. Thereafter, the workpiece can be removed from the thread rolling head.

Before starting a new working cycle it is necessary to "lock" the rolling head again. This usually is done by hand. A so-called spring housing with the helical spring contained therein is turned in reverse direction by hand or by corresponding means. As the helical spring is axially extended during the described releasing procedure the shank and the bearing unit are caused to be tensioned. As soon as the moving back of the spring housing has reached a preset value the claw clutch mentioned before locks into place again and the thread rolling head is locked.

It is the object of the invention to provide an axial thread rolling head where the thread rolling head can be locked automatically.

The axial thread rolling head according to the invention comprises a drive, preferably an electrical motor, arranged on the shank and connected to the bearing unit by means of a second gear for relatively twisting the bearing unit into the first direction of rotation by a preset angle of rotation as soon as the shank and the bearing unit have reached the second axial relative position. With other words the motor provided on the shank twists the bearing unit into the locking position of the rolling head by means of a suitable gear, with the claw clutch, as already mentioned before, being locked automatically again.

It goes without saying that there also can be used a hydraulic, pneumatic or another drive, especially a so-called direct drive which does not need a gear.

If using an electrical motor it is certainly thinkable to feed it front outside as it is stationarily arranged on the shank being axially movable only. However, a battery supply is to be preferred. Correspondingly, according to an embodiment of the invention, the shank comprises means for receiving a battery.

According to another embodiment of the invention, there is arranged on the shank at least one sensor for receiving a contactlessly transmitted control signal for the driving motor. Preferably, the sensor is an infrared sensor. If the rolling head according to the invention is arranged within a N/C machine the control for the driving motor may be part of the program. For this purpose, the N/C machine can also receive a signal when the thread rolling head has been released and/or the workpiece has left the rolling head so as to be aide to start the locking procedure. It goes without saying that besides the sensor a control circuit is also to be associated to the motor which causes the motor to be turned on and off as a result of the transmitted signal. Turning off, however, may be easily performed by a limit switch which turns off the motor as soon as a given angle of rotation has been reached.

There may be used various ways to form the gear so as to displace the bearing unit by twisting. According to an embodiment of the invention, there is arranged on the motor shaft a small pinion meshing with a toothed segment of a rotatably supported switch ring which transfers a rotational movement to the bearing unit. For this purpose, the switch ring may comprise an engaging portion which cooperates with an engaging portion of the bearing unit.

According to another embodiment of the invention, the motor is arranged within an annular casing provided on the shank. If using a battery box, it, preferably, also is annularly arranged on the shank and, preferably, is provided adjacent to the annular motor casing.

According to a further embodiment of the invention, the bearing unit comprises a spring housing rotatably supported on the shank and forming the claw clutch together with the shank. It goes without saying that the relative rotation of the spring housing and the shaft is only possible if the claw clutch is out of mesh. The spring housing and the switch ring are surrounded by a common covering. The covering causes the switch ring to be also engaged in case of an axial displacement of the spring housing as a result of the before described abutment against the workpiece.

The invention will be more detailedly explained hereinafter with the aid of drawings.

DETAILED DESCRIPTION OF THE INVENTION

Figure 1:
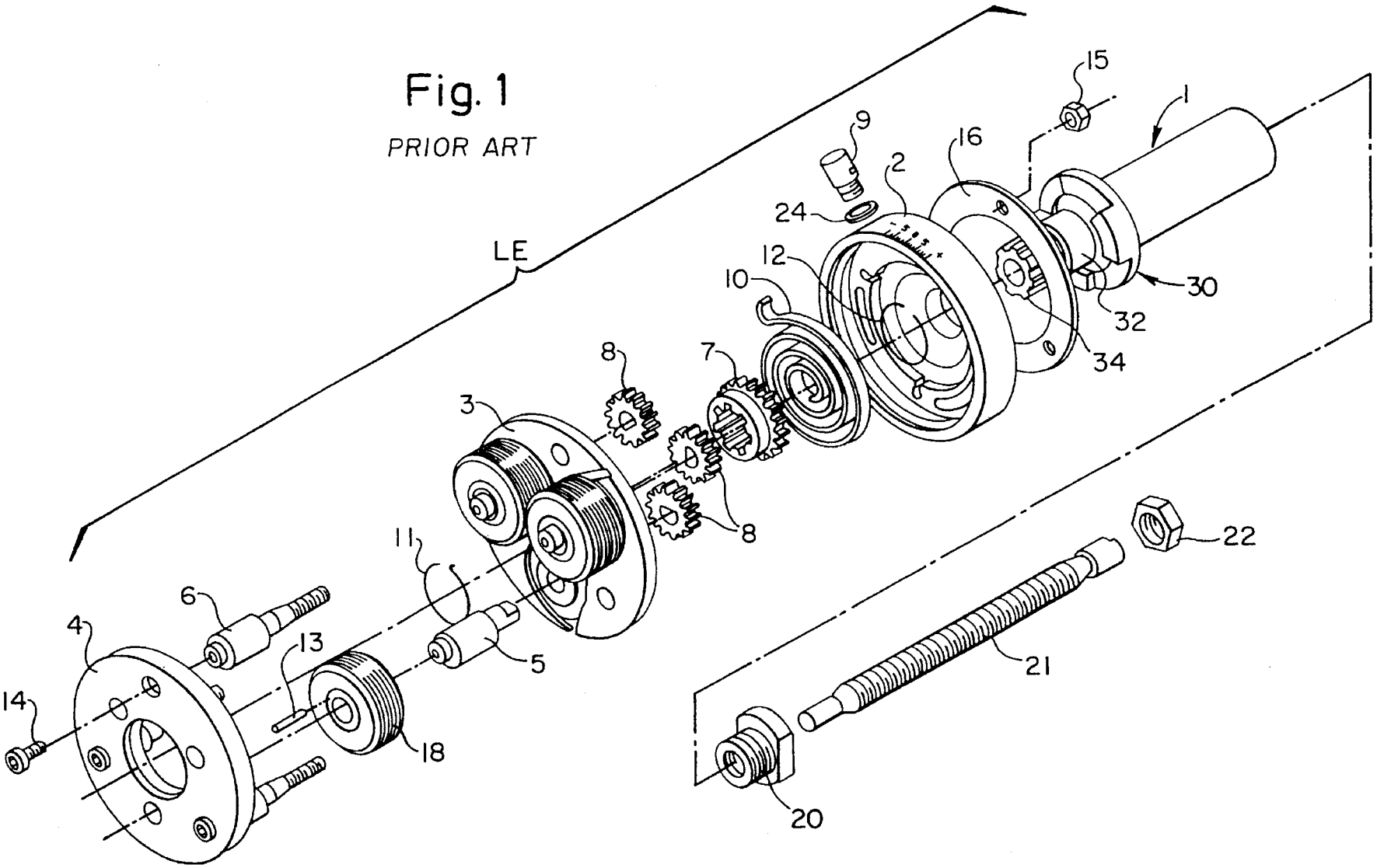
Fig. 1 PRIOR ART
FIG. 1 shows an exploded view of a known thread rolling head.

First of all, reference is made to FIG. 1 where a conventional axial thread rolling head is shown. It comprises one bearing unit LE and one shank 1. As appears therefrom, the shank 1 which, for example, may be clamped into a numerically controlled machine tool, comprises a coupling portion 30 as well as a cylindrical bearing portion 32 and a spline connection portion 34.

The bearing unit comprises three profile rollers 18, each of which being supported on eccentric shafts 5. The ends of the eccentric shafts 5 are arranged in corresponding bores of a front plate 4 and a distance plate 3. Both plates 3, 4 are spaced from each other by bolts 6. The thread portion of bolt 6 extends through corresponding bores provided in the distance plate 3. The profile rollers 18 are rotatably supported on the eccentric shafts 5 which, at the rear end, are flattened, said flattened end cooperating with correspondingly formed bores of gear wheels 8 meshing with a central gear wheel 7. The central gear wheel is arranged on the spline connection portion 34 of the shank 1. Rotation of the central gear wheel 7 causes the gear wheels 8 and, thus, the eccentric shafts to rotate, too. A displacement of the eccentric shafts 5 by means of twisting results in a change of the distance between the profile rollers 18. The thread milling makes a preset distance between the profile rollers necessary. This distance must be increased for removing the workpiece between the rollers 18.

A spring housing 2 with a central bore is arranged on a bearing portion 32 and comprises a claw clutch portion (not shown) which cooperates with the claw clutch portion 30 of the shank 1. In the spring housing 2 a helical spring 10 is arranged, the outer end of which cooperates with a slot within the spring housing 2. The inner end of the helical spring 10 is connected to the portion 32 of the shank 1 (not shown). In a bore 24 of the spring housing 2 a shank 9 is provided which can be twisted with the spring housing 2 if the claw clutch portions are out of mesh.

Spring rings 11, 12 guarantee the axial support of the bearing unit LE on the shank 1 and the thread portions of bolts 6 extend through bow-shaped elongated holes of the spring housing 2 and bores through a disk 16. The spring housing 2 is permanently screwed on the distance plate 3 by means of screw nuts 15, with the relative position of rotation being exactly adjustable before. For this purpose, a scale is provided on the spring housing 2.

A bolt 21 is secured in shank 1 with the aid of two screw nuts 20, 22, said bolt 21 being adjustable on account of its thread portion in its relative position within the shank 1.

The function of the shown rolling head is as follows. The rollers 18 are spaced apart from each other at a preset distance while the claw clutch portions are in meshing engagement with each other. Thereat the helical spring 10 is under tension. To mill a thread into a workpiece which is guided between rollers 18 (not shown) the workpiece moves into the rolling head or respectively, the bearing unit LE until it abuts against bolt 21. In this way, the feed of shank 1 is terminated together with the bearing unit LE and the bearing unit LE itself continues moving as a result of the described feed. This causes the claws of the claw clutch to get out of mesh and the spring housing 2 and, consequently, the bearing unit LE performs a turn in consequence of the spring action of helical spring 10, said turn only being performed over a preset angle of rotation as a result of the out-of-mesh-portion of the claw clutch. This relative turn of the shaft 1 and the bearing unit LE, as described before, cause the eccentric shafts 5 to be displaced by twisting so that the rolling head is released. The workpiece thus can be removed from the rolling head. To lock the rolling head again the spring housing 2 must be displaced by twisting in the opposite direction via shaft 9 until the claw clutch can lock into place again. As during the described releasing procedure the bearing unit LE has been axially removed from shank 1, a tension force was also exerted on the helical spring 10. With the aid of this tension force the claw clutch portions are caused to return into their locking position. Thus the rolling head is again locked for a new working cycle.

As far as FIGS. 2 to 16 show parts which are identical to those according to FIG. 1, there are used the same reference numbers by adding an "a".

Figure 2:
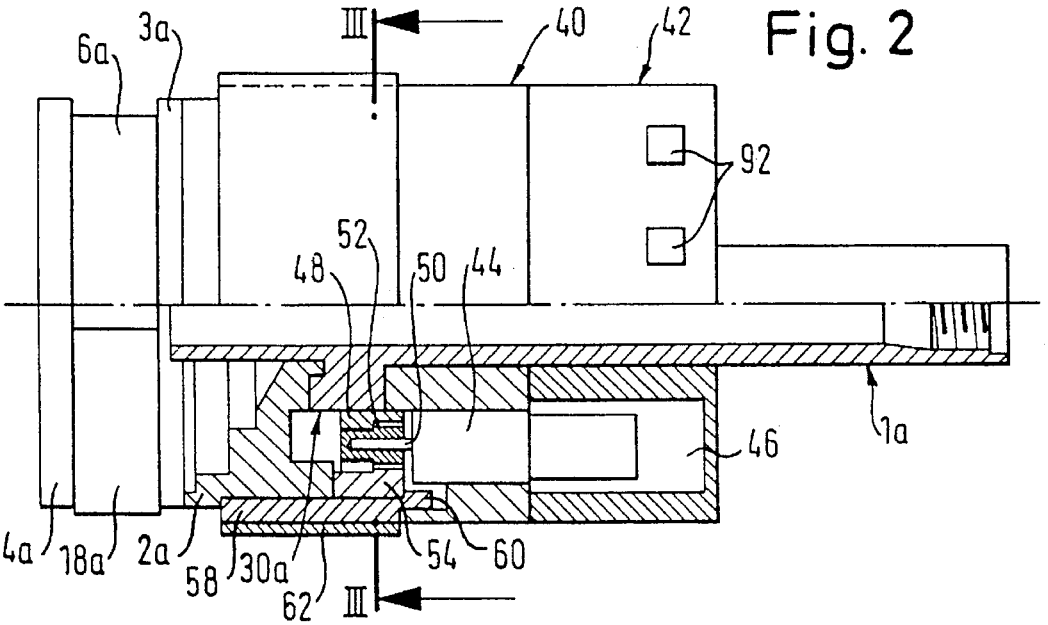
FIG. 2 shows a view, partly in section, of the rolling head according to the invention.

It appears from FIG. 2 that behind the claw clutch portion 30*a* of the shank la an annular motor casing 40 is arranged on shank 1*a*. Adjacent to the motor casing 40 an annular battery housing 42 is arranged on shank 1*a*. An electrical motor 44 is received by an eccentric bore of the casing 40 and extends into a bore 46 of the battery housing 42. There is still entered into further details later on. The reference to an electrical motor is made by way of example only and must not be interpreted as any limitation.

A bearing unit 48 connected to the motor casing 40 carries a motor shaft 50 which comprises a pinion 52. The pinion meshes with a toothed segment of a switch ring 54 which strikes against the right side of the spring housing 2*a*. A covering 58 surrounds the spring housing 2*a* as well as the switch ring 54, said covering 58 abutting against a projection of the spring housing 2*a* while forming an axial limitation for the switch ring 54 together with a projection 60. In this way, the switch ring 60 can rotate whenever there is a rotation of the pinion 52 but an axial movement can only be performed together with the spring housing 2*a*. The covering 58 is surrounded by a protective covering 62.

Figure 3:
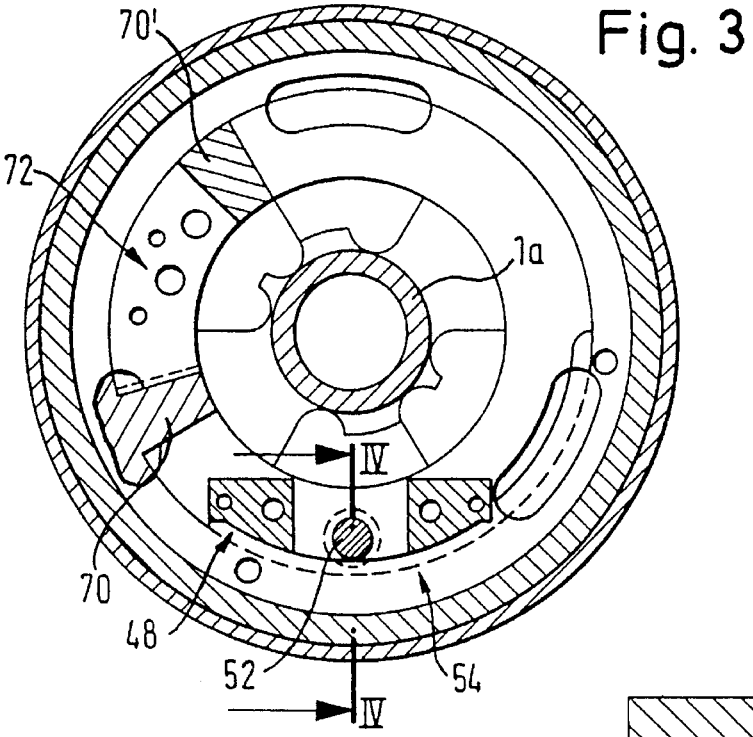
FIG. 3 shows a sectional view of FIG. 2 taken along the line 3—3.
Figure 4:
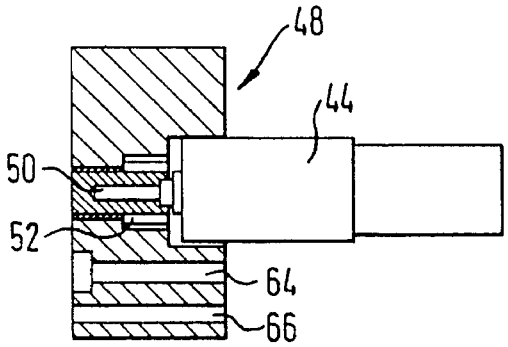
FIG. 4 shows a sectional view of FIG. 3 taken along the line 4—4.

FIG. 4 shows the bearing component 48 where only two bores 64, 66 are demonstrated, the first one of which receiving a screw bolt and the second one of which receiving a pin for the purpose of connecting to the motor casing 40 (see FIG. 3 and also FIG. 13) which still will be more detailedly explained later on.

Figure 11:
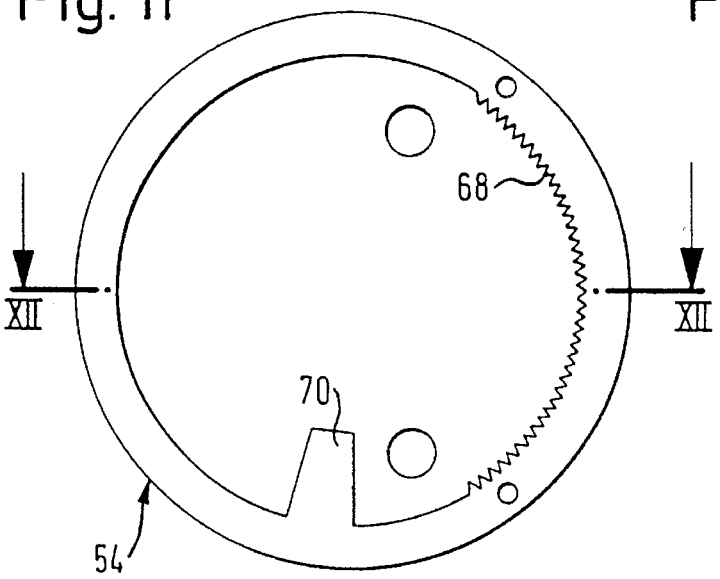
FIG. 11 shows a final view of the switch ring of the claw clutch according to FIG. 2.
Figure 12:
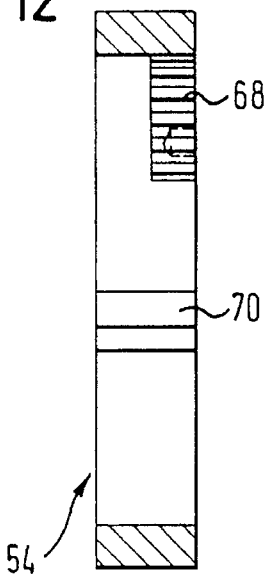
FIG. 12 shows a sectional view of the switch ring according to FIG. 11 taken along the line 12—12.

In FIGS. 11 and 12 the switch ring, 54 is demonstrated more clearly. It shows a toothing 68 arranged in segments inside and meshing with the pinion 52. The toothing extends over an angle of about 120°. The switch ring 54 comprises a finger 70 radially pointing inwardly. As can be seen from FIG. 3, the finger 70 cooperates with a stop element 72 which is arranged on the right or rear side of the spring housing 2*a*. The locked position is demonstrated at 70'. Between the locked and the released position an angle of rotation of about 60° is contained.

Figure 5:
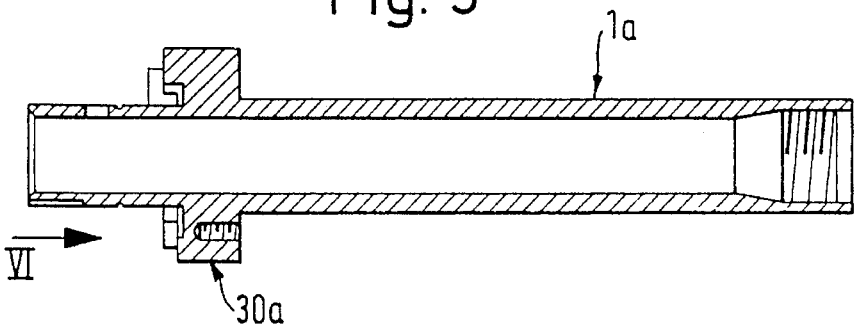
FIG. 5 shows the shank of the thread rolling head according to FIG. 2.
Figure 6:
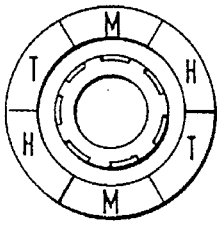
FIG. 6 shows the final view of the shank according to FIG. 5 in the direction of arrow 6.
Figure 7:
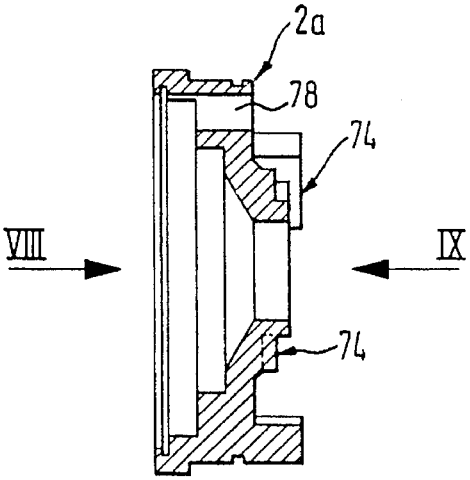
FIG. 7 shows the spring housing of the thread rolling head according to FIG. 2.
Figure 8:
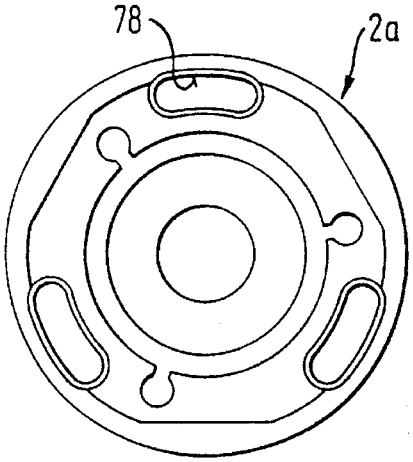
FIG. 8 shows the final view of the spring housing according to FIG. 7 in the direction of arrow 8.
Figure 10:
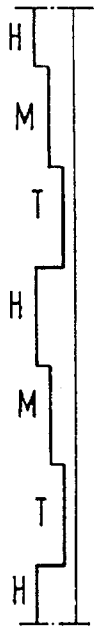
FIG. 10 shows a developed view of the claw clutch portion of the spring housing according to the FIGS. 7 to 9.
Figure 9:
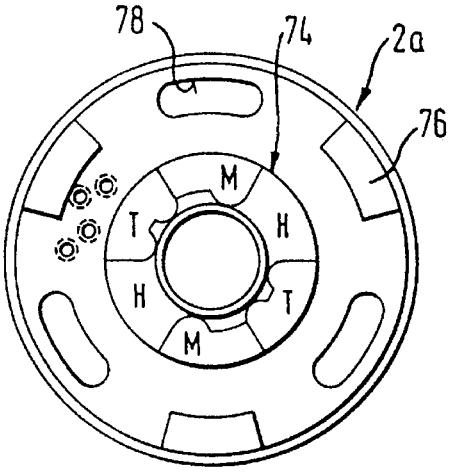
FIG. 9 shows the final view of the spring housing according to FIG. 7 in the direction of arrow 9.

In FIGS. 5 and 6 the shank 1*a* is more detailedly demonstrated. One can see that the coupling portion 30*a* comprises three pairs of claw portions, namely high, middle and deep, which in FIG. 6 are marked by H, M and T. As shown in FIGS. 7, 9 and 10, they cooperate with corresponding claws of the claw clutch portion 74 of the spring housing 2*a*. FIGS. 9 and 10 show the deep, mid and high portions (H, M, T). Furthermore, three claws 76 are provided more outside at the rear side of the spring housing 2*a* being spaced 120° apart and engaging the switch ring 54. Besides, in the 10 o'clock position according to FIG. 9, those bores are shown above which said stop element 72 is secured together with the spring housing 2*a*. Moreover, FIGS. 7, 8 and 9 show the bow-shaped elongated holes 78 through which the bolts do extend according to bolts 6 of FIG. 1 for connecting the parts as to form a bearing unit.

Figure 13:
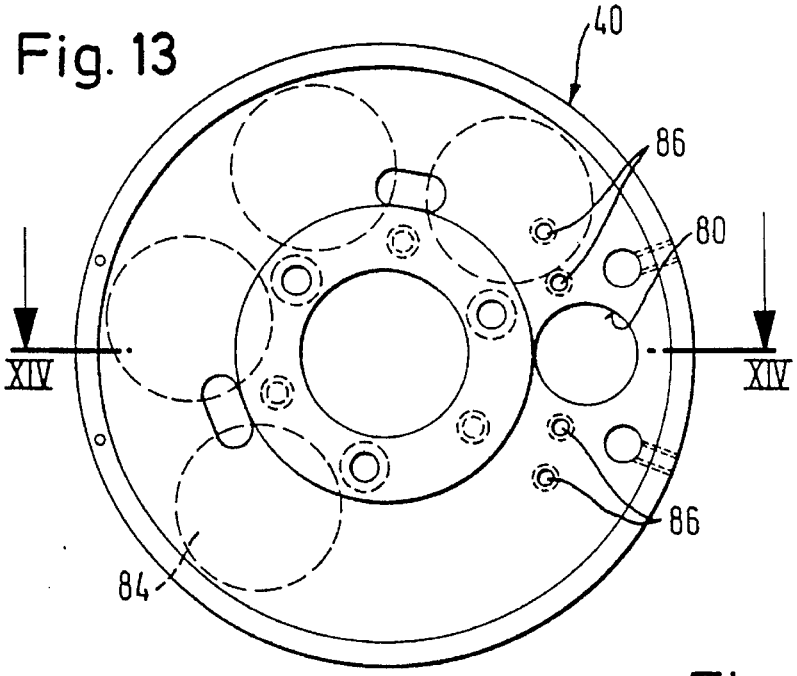
FIG. 13 shows a final view of the motor casing of the rolling head according to FIG. 2.
Figure 14:
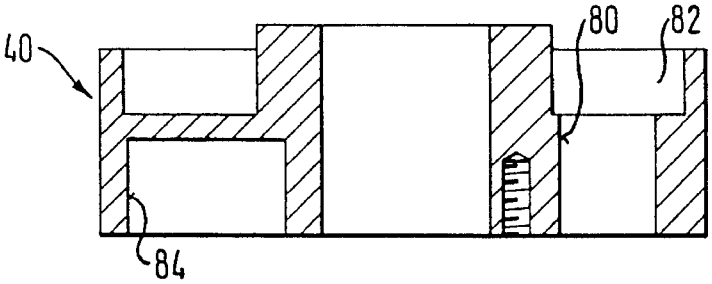
FIG. 14 shows a sectional view of the motor casing according to FIG. 13 taken along the line 14—14.
Figure 16:
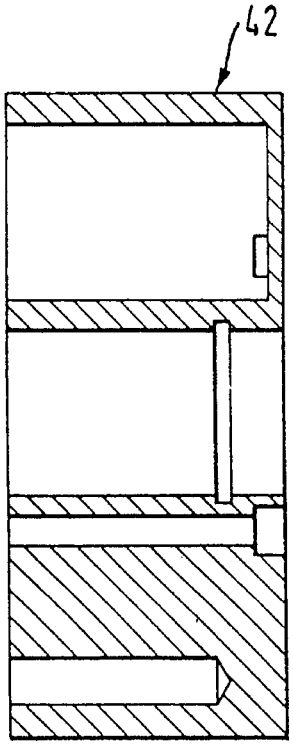
FIG. 16 shows a sectional view of the battery box according to FIG. 15 taken along the line 16—16.
Figure 15:
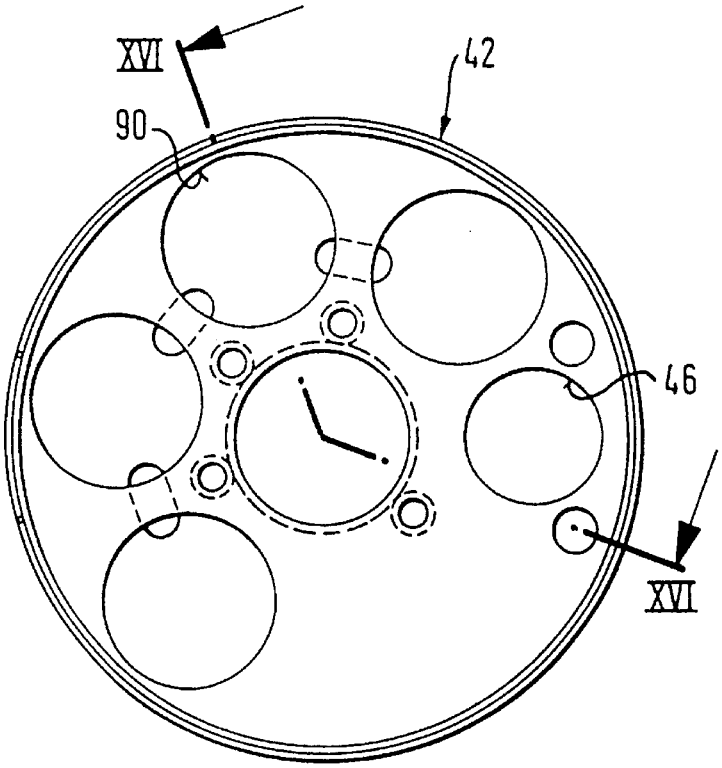
FIG. 15 shows a final view of the battery box of the rolling head according to FIG. 2.

In FIGS. 13 and 14 the motor casing 40 is demonstrated more detailedly. It comprises an eccentrically provided bore 80 which receives the motor 44. The bore 80 ends in an annular recess 82 of the casing 40 into which recess the right portion of the covering 58 with its shoulder 60 extends. At the rear side the casing 40 comprises cylindrical recesses 84 parallel to the axis which are aligned with corresponding recesses in the battery box still to be described for receiving batteries.

FIG. 13 thread bores are shown at 86 which are intended to connect the bearing portion 48 (FIGS. 3 and 4) to the motor casing 40.

The battery box 42 arranged adjacent to the motor casing 40 comprises cylindrical recesses 90 which are aligned with the recesses 84 of the motor casing 40 for receiving batteries. Besides, it also comprises recess 46 for receiving the rear portion of the motor 44.

As indicated in FIG. 2, two infrared sensors 92 are arranged in the battery box 46 which receive infrared signals, for instance from the N/C machine, for driving the motor 44 via a suitable control circuit (not shown). The control circuit may be provided in the motor casing 40 or in the battery box 42.

The function of the thread rolling head according to FIGS. 7 to 16, with respect to the working cycle and the release after performing thread milling, corresponds to that of the rolling head according to FIG. 1. It, therefore, is not necessary to detailedly explain it again. However, it is important to mention that during the reversed rotation of the spring housing 2*a* the engaging portion or stop element 72 via the finger 70 displaces the switch ring into a position as it is shown in FIG. 3 at about 8 o'clock. During this procedure the high or, respectively, deep portions of the claw clutch are out of mesh while the mid portions have been brought into engagement so that during the described releasing procedure a rotation over the corresponding deep and high portions is restricted after 60°. As soon as the workpiece has been removed from the rolling head the motor can receive a corresponding signal in the form of an infrared signal from the N/C machine. The sensors 92 drive the motor via the control circuit (not shown) and start it. It starts rotational movement, with its pinion 52 displacing the switch ring 54 by twisting. During the described releasing movement where shank 1*a* and the spring housing 2*a* have moved apart by a few millimeters to cause the spring housing 2*a* to be displaced by twisting, the spring housing 2*a* has axially engaged the switch ring 54 via covering 58. The meshing between the pinion 52 and the toothed segment 68, however, remains unaffected. Thus, the rotation of the motor results in a rotation of the switch ring 54 which moves the spring housing 2 back via finger 70 and the engaging portion 72 until the corresponding high and deep portions of the claw clutch are facing each other and can lock in position as a result of the axial function of the helical spring (not shown). The helical spring arranged in connection with the rolling head according to FIG. 2 is arranged within the spring housing in the same way as this has been described in connection with FIG. 1. As soon as the angle of rotation has been reached, a limit switch causes the motor to cut off. The cut-off signal or, respectively, another signal indicating the termination of the locking procedure of the rolling head, in turn, can be transmitted to the N/C machine in a contactless way so as to initiate another working cycle.

I claim:

1. An axial thread rolling head constructed and arranged to be mounted in a chuck of a tool machine, said axial thread rolling head comprising:

a plurality of thread rollers;

a bearing unit including the thread rollers and rotatably supporting said thread rollers by means of eccentric shafts;

an axial shank being axially movable with respect to said bearing unit and, in a first axial relative position, cooperating with a claw clutch portion of said bearing unit by means of a second claw clutch portion to connect both portions so as to be resistant to torsional strength;

a first gear between said shank and said eccentric shafts;

a helical spring between said shank and said bearing unit being so provided that in a second axial relative position, in which said claw clutch portions are out of mesh, said helical spring, upon displacement of said bearing unit into a first direction of rotation with respect to said shank, is tensioned or, respectively, said tensioned helical spring displaces said bearing unit into a second direction of rotation relative to said shank;

spring means which tension said shank and said bearing unit into the first axial relative position towards each other; and mechanical switching means which, when contacting a workpiece, causes said shank and said bearing unit to move into the second axial relative position, wherein a power-operated drive (44) is arranged on said shank (1*a*) which is connected to said bearing unit (LE) via a second gear (52, 54, 68) for displacing said bearing unit (LE) into the first direction of rotation by a preset angle of rotation, with said shank (1*a*) and said bearing unit (LE) being in the second axial relative position.

2. The thread rolling head of claim 1, wherein the drive is an electrical motor and a means (42) for receiving batteries is arranged on said shank (1*a*).

3. The rolling head of claim 1 or 2, wherein at least one sensor is arranged on said shank (1*a*) for receiving a contactlessly transmitted control signal for said electrical motor (44).

4. The rolling head of claim 1 further comprising a limit switch which puts said drive (44) out of circuit as soon as the preset angle of rotation has been reached.

5. The thread rolling head of claim 1, wherein said power operated drive comprises a motor including a motor shaft, whereupon said motor shaft, a pinion (52) is arranged meshing with a toothed segment (68) of a rotatably supported switch ring (54) which transfers a rotational movement to said bearing unit (LE).

6. The thread rolling head of claim 1 wherein said drive (44) is arranged within an annular casing (40) provided on said shank (1*a*).

7. The thread rolling head of claim 3 further comprising an infrared sensor (92).

8. The thread rolling head of claim 5 wherein said switch ring (S4) comprises an engaging portion (70) which cooperates with an engaging portion (72) of said bearing unit (LE).

9. The thread rolling head of claim 5 wherein said bearing unit (LE) comprises an annular spring housing (2*a*) rotatably supported on said shank (1*a*), said annular spring housing (2*a*) and said shank (1*a*) forming a claw clutch engagement via said claw clutch portions, and said spring housing (2*a*) and switch ring (54) are surrounded by a covering (58) which axially connects said spring housing (2*a*) and said switch ring (54).

10. The thread rolling head of claim 6 wherein an annular battery box (42) is arranged on said shank (1*a*).

11. The thread rolling head of claim 6 wherein said bearing unit (LE) comprises an annular spring housing (2*a*) rotatably supported on said shank (1*a*), said annular spring housing (2*a*) and said shank (1*a*) forming a claw clutch engagement via said claw clutch portions, and said spring housing (2*a*) and switch ring (54) are surrounded by a covering (58) which axially connects said spring housing (2*a*) and said switch ring (54).

* * * * *